US006253647B1

(12) United States Patent
Eggert et al.

(10) Patent No.: US 6,253,647 B1
(45) Date of Patent: Jul. 3, 2001

(54) REVERSIBLE RATCHET WITH REMOTE REVERSING OPERATING MECHANISM

(75) Inventors: Daniel M. Eggert, Kenosha; Dean J. Iwinski, Muskegon, both of WI (US)

(73) Assignee: Snap-on Technologies, Inc., Lincolnshire, IL (US)

( * ) Notice: Subject to any disclaimer, the term of this patent is extended or adjusted under 35 U.S.C. 154(b) by 0 days.

(21) Appl. No.: 09/478,100

(22) Filed: Jan. 5, 2000

(51) Int. Cl.[7] ..... B25B 13/46
(52) U.S. Cl. ..... 81/63
(58) Field of Search ..... 81/60, 61, 62, 81/63, 63.1, 63.2

(56) References Cited

U.S. PATENT DOCUMENTS

| | | | |
|---|---|---|---|
| 228,827 | | 6/1880 | Mell . |
| 282,462 | | 7/1883 | Lancaster . |
| 460,474 | | 9/1891 | Knapp et al. . |
| 581,427 | | 4/1897 | Olson . |
| 683,167 | | 9/1901 | Adams . |
| 685,698 | | 10/1901 | Sprague . |
| 753,703 | | 3/1904 | Harris . |
| 754,012 | | 3/1904 | Reams . |
| 889,720 | | 6/1908 | Morley . |
| 893,097 | | 7/1908 | Reams . |
| 897,584 | | 9/1908 | Carlson . |
| 951,056 | * | 3/1910 | Clark ..... 81/63 |
| 981,202 | | 1/1911 | Lane . |
| 1,033,358 | | 7/1912 | Turner . |
| 1,072,807 | | 9/1913 | Ayer . |
| 1,078,059 | | 11/1913 | Mossberg . |
| 1,087,316 | | 2/1914 | Packer . |
| 1,095,347 | | 5/1914 | Nimsgern . |

(List continued on next page.)

FOREIGN PATENT DOCUMENTS

| | | |
|---|---|---|
| 467054 | 8/1950 | (CA) . |
| 688366 | 2/1940 | (DE) . |
| 710248 | 9/1941 | (DE) . |
| 809746 | 10/1951 | (DE) . |
| 3602570 C1 | 7/1987 | (DE) . |
| 3818470 | 3/1989 | (DE) . |
| 610903 | 9/1926 | (FR) . |
| 709547 | 8/1931 | (FR) . |
| 1004690 | 4/1952 | (FR) . |
| 1538615 | 9/1968 | (FR) . |
| 11947 | of 1891 | (GB) . |
| 190349 | 12/1922 | (GB) . |
| 2223971 | 4/1990 | (GB) . |
| 254498 | 7/1927 | (IT) . |
| 270861 | 1/1930 | (IT) . |
| 283805 | 3/1931 | (IT) . |

*Primary Examiner*—Joseph J. Hail, III
*Assistant Examiner*—Joni B. Danganan
(74) *Attorney, Agent, or Firm*—Seyfarth Shaw

(57) ABSTRACT

A ratchet wrench is provided which includes a handle having an exterior surface, a head coupled to the handle, a rotatable gear disposed in the head and having ratchet teeth, and a rotatable pawl moveable between a first pawl position in which the pawl is engaged with the gear to allow rotation of the gear in a first direction and substantially prevent rotation of the gear in a second direction and a second pawl position in which the pawl is engaged with the gear to allow rotation of the gear in the second direction and substantially prevent rotation of the gear in the first direction. The wrench includes an elongated rotatable rod disposed in the handle having an actuator disposed at a first end of the rod and inclined with respect to the axis of the rod, the rod being rotatable from a first rod position wherein the actuator biases the pawl to the first pawl position and to a second rod position wherein the actuator biases the pawl to the second pawl position. An operating mechanism is disposed at the exterior surface of the handle and coupled to the rod.

14 Claims, 6 Drawing Sheets

U.S. PATENT DOCUMENTS

| | | | | |
|---|---|---|---|---|
| 1,177,764 | | 4/1916 | Dodge . | |
| 1,199,737 | | 9/1916 | Ayer . | |
| 1,422,121 | | 7/1922 | Millen . | |
| 1,563,883 | | 12/1925 | Waters . | |
| 1,883,618 | | 10/1932 | Dodge . | |
| 1,926,103 | | 9/1933 | Kerns . | |
| 2,003,346 | | 6/1935 | Dodge . | |
| 2,393,413 | | 1/1946 | Rober . | |
| 2,590,387 | | 3/1952 | Dodge . | |
| 3,128,079 | | 4/1964 | DeGroff . | |
| 3,608,402 | | 9/1971 | Rainey . | |
| 3,659,484 | | 5/1972 | Scodeller . | |
| 3,724,560 | | 4/1973 | Tibbott . | |
| 4,231,270 | | 11/1980 | Totsu . | |
| 4,254,675 | | 3/1981 | Marlow et al. . | |
| 4,265,320 | | 5/1981 | Tanaka et al. . | |
| 4,274,311 | | 6/1981 | Ebert . | |
| 4,277,989 | * | 7/1981 | Tracy | 81/62 |
| 4,308,769 | * | 1/1982 | Rantanen | 81/63 |
| 4,419,911 | | 12/1983 | Claudy . | |
| 4,452,107 | | 6/1984 | Waiser . | |
| 4,545,267 | | 10/1985 | Shumway . | |
| 4,566,356 | | 1/1986 | Herota . | |
| 4,869,138 | | 9/1989 | Farris . | |
| 4,967,624 | | 11/1990 | Farris . | |
| 5,044,234 | | 9/1991 | Cheng . | |
| 5,230,262 | | 7/1993 | Ahlund et al. . | |
| 5,584,220 | * | 12/1996 | Darrah et al. | 81/63 |

* cited by examiner

REVERSIBLE RATCHET WITH REMOTE REVERSING OPERATING MECHANISM

BACKGROUND OF THE INVENTION

1. Field of the Invention

This invention relates to hand tools, and more particularly, to reversible ratchet wrenches.

2. Description of the Prior Art

In the past, reversible ratchet wrenches have been provided with levers located in the head of the wrench to control the direction of ratcheting. These constructions generally required two-hand operation by the user to move the lever in order to change the direction of ratcheting.

Reversible ratchet wrenches have also been provided with operating mechanisms remote from the head to change the direction of ratcheting. These mechanisms were complicated and still often required two-hand operation.

SUMMARY OF INVENTION

It is a general object of the invention to provide an improved reversible ratchet wrench which avoids the disadvantages of prior ratchet wrenches while affording additional structural and operational advantages.

An important feature of the invention is the provision of a ratchet wrench which is of relatively simple and economical construction.

A further feature of the invention is the provision of a wrench of the type set forth which can be operated with one hand to change the direction of ratcheting.

Another feature of the invention is the provision of a wrench of the type set forth which minimizes wear of its moving parts.

Another feature of the invention is the provision of a wrench of the type set forth which prevents self-reversing of the pawl when using an extension with high prevailing torque.

Certain ones of these or other features may be attained by providing a ratchet wrench which includes a handle having an exterior surface, a head coupled to the handle, a rotatable gear disposed in the head and having ratchet teeth, and a rotatable pawl moveable between a first pawl position in which the pawl is engaged with the gear to allow rotation of the gear in a first direction and substantially prevent rotation of the gear in a second direction and a second pawl position in which the pawl is engaged with the gear to allow rotation of the gear in the second direction and substantially prevent rotation of the gear in the first direction. The wrench also includes an elongated rotatable rod disposed in the handle having an actuator disposed at a first end of the rod and inclined with respect to the axis of the rod. The rod is rotatable from a first rod position, wherein the actuator biases the pawl to the first pawl position, to a second rod position, wherein the actuator biases the pawl to the second pawl position. The wrench also includes an operating mechanism disposed at the exterior surface of the handle and coupled to the rod.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
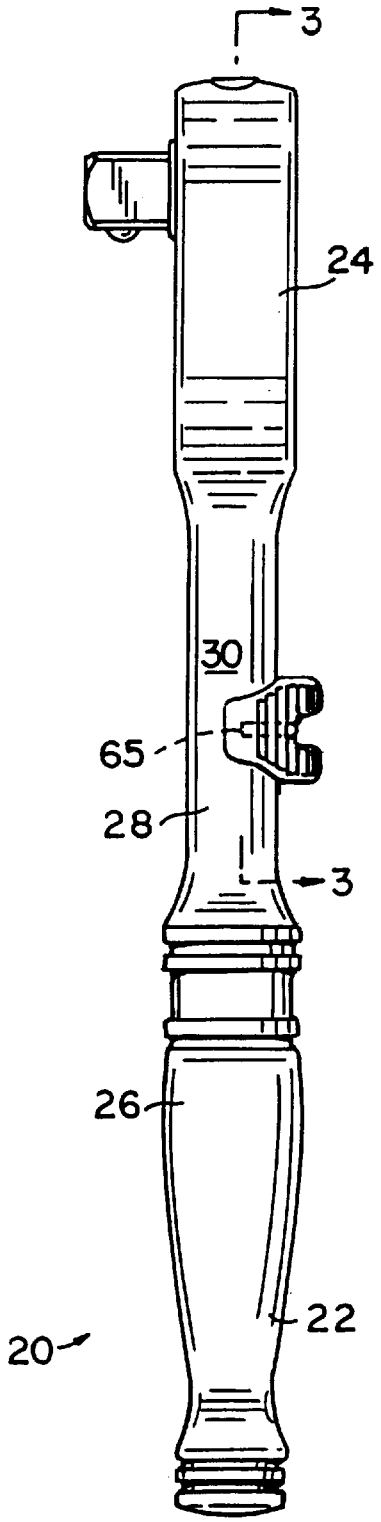
FIG. 1 is a side elevational view of the wrench of the present invention.

Referring to FIG. 1, a reversible ratchet wrench 20 is illustrated. The wrench 20 includes a handle 22 coupled to a head 24. The handle 22 has a hand-engaging portion 26 coupled to a substantially cylindrical portion 28 having an exterior surface 30.

Figure 2:
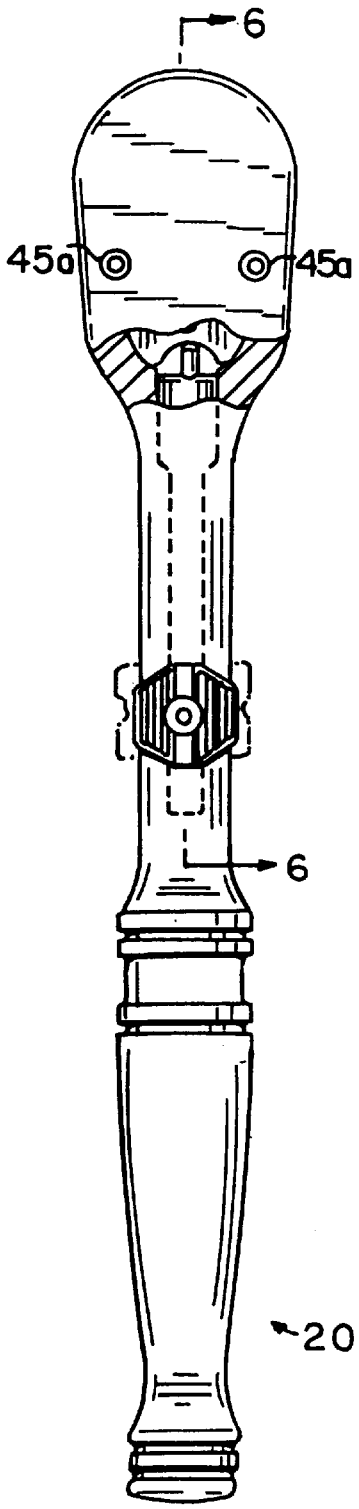
FIG. 2 is a top plan view, partially broken away, of the wrench of FIG. 1.
Figure 4:
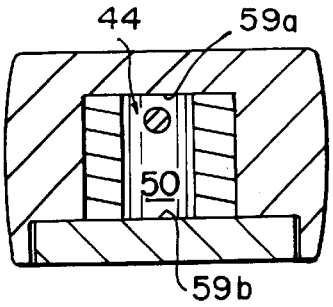
FIG. 4 is a sectional view taken generally along line 4—4 of FIG. 3.
Figure 3:
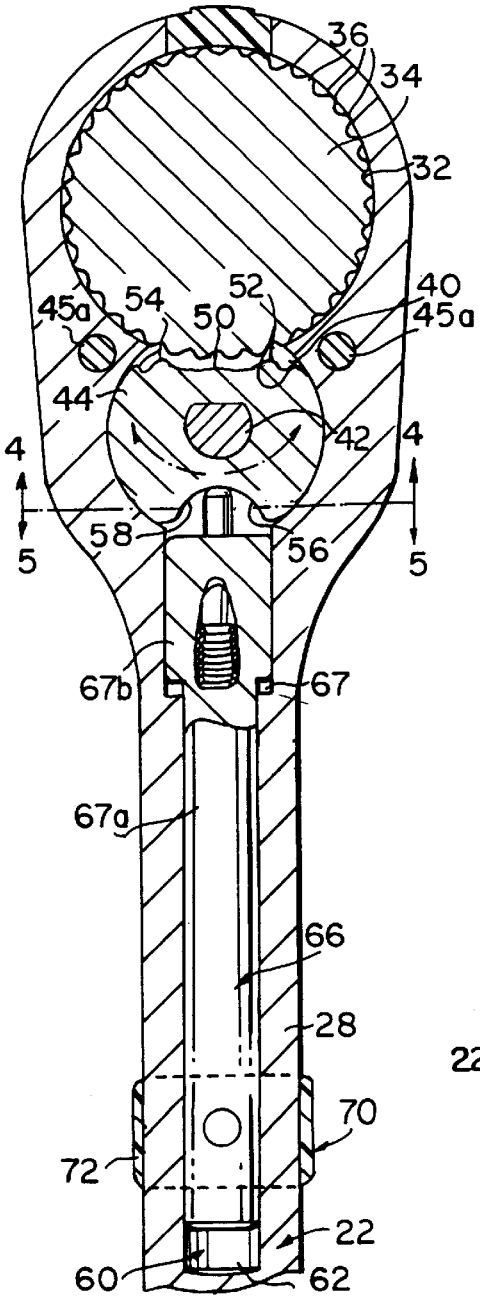
FIG. 3 is an enlarged, fragmentary, sectional view taken generally along line 3—3 of FIG. 1.
Figure 6:
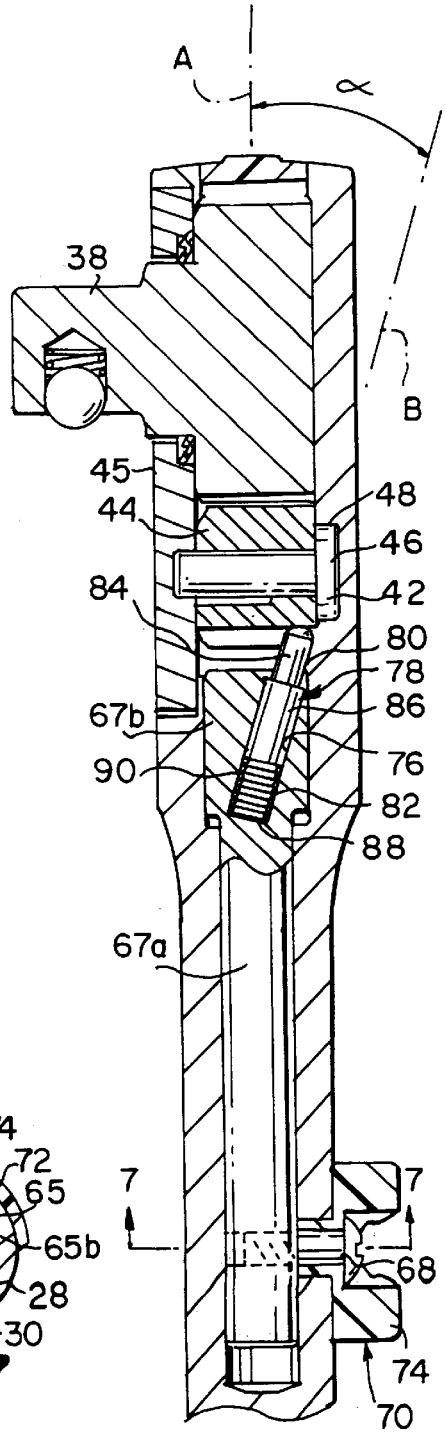
FIG. 6 is a fragmentary sectional view taken generally along line 6—6 of FIG. 2.

The head 24 defines a cavity 32 and houses a rotatable gear 34 (FIG. 3) having ratchet teeth 36 and a square drive 38 (FIG. 6) for engaging a socket (not shown). The head 24 also has a smaller, substantially part-cylindrical cavity 40 housing a pawl pin 42 and a pawl 44 rotatable about the axis of pawl pin 42. As seen in FIG. 6, the rotatable gear 34, the pawl pin 42 and pawl 44 are maintained within the head 24 by a cover plate 45 fixed to the head 24 by fasteners 45*a* (FIGS. 2 and 3). As seen in FIG. 6, the pawl pin 42 has a head 46 seated in a recess 48 to fix the pawl pin 42 in a fixed position along the axis of the wrench 20. The pawl pin 42 and pawl 44 may be a one-piece construction. The pawl 44, as seen in FIG. 3, has a first side 50 with clockwise torque teeth 52 and counter-clockwise torque teeth 54 and a second opposite side 56 with a concave detent surface 58. As seen in FIG. 4, the pawl 44 has an upper surface 59*a* and a lower surface 59*b* defining the thickness of the pawl 44. The concave surface 58 extends across the entire thickness of the pawl 44.

Figure 7:
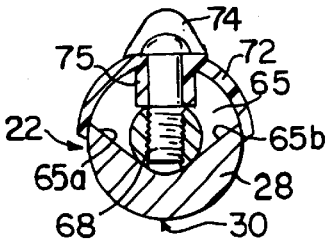
FIG. 7 is a sectional view taken generally along line 7—7 of FIG. 6.

As seen in FIG. 3, the handle 22 includes a bore 60 communicating with the cavity 40. The bore 60 has a smaller diameter portion 62 and a larger diameter portion 64 which is shorter than smaller diameter portion 62 and which communicates with cavity 40. As seen in FIGS. 1 and 7, the handle 22 also includes a slot 65 opening at the exterior surface 30 communicating with smaller diameter portion 62 and having sidewalls 65*a* and 65*b*. An elongated rod 66 having an axis A (FIG. 6) is disposed in the bore 60. The rod 66 includes a smaller diameter portion 67*a* and a larger diameter portion 67*b*. The smaller diameter portion 67*a* is coupled by a fastener 68 to a button 70. The smaller diameter portion 67*a* may also have a groove and an o-ring disposed in the groove (not shown) to form a seal with the smaller diameter portion 62 of the bore 60 to prevent dirt that may enter under the button 70 from reaching the ratchet mechanism. The button 70 has a saddle-shaped portion 72 extending about a portion of the circumference of the substantially cylindrical portion 28 of the handle 22 (FIG. 7). The saddle-shaped portion 72 has an engaging portion 74 which is generally triangular in transverse cross-section and contoured to ergonomically receive a user's fingers. The engaging portion 74 projects radially outward from the substantially cylindrical portion 28. The button 70 also includes a cylindrical portion 75 coupled to the engaging portion 74 and disposed about the fastener 68 in slot 65. The cylindrical portion 75 acts as a spacer and has a height which prevents the saddle-shaped portion 72 from frictionally dragging against the cylindrical portion 28 and restricting operation when the button 70 is securely tightened to rod 66. The button 70 is spaced from the head 24 and the engaging portion 74 is easily engageable by a user's thumb when the remainder of the user's hand is disposed about the hand-engaging portion 26.

As seen in FIG. 6, the larger diameter portion 67*b* of the rod 66 includes a bore 76 inclined with respect to the axis A of the rod 66. An actuator 78 is disposed within the bore 76. The actuator 78 includes a plunger 80 and a spring 82. The plunger 80 has an axis B (FIG. 6) coaxial with the axis of the bore 76, a bullet-shaped head 84 at one end, a larger diameter cylindrical central portion 86, and a smaller diameter cylindrical portion 88. A shoulder 90 is formed between portions 86 and 88. The spring 82 is disposed about portion 88 and acts on the shoulder 90 to bias the bullet-shaped head 84 to assure constant contact against the concave surface 58 of the pawl 44.

The rod 66 is rotatable about its axis A among several positions to control rotation of the rotatable gear 34. When the cylindrical portion 75 of the button 70 is placed in the center of the slot 65, the rod 66, is caused to be placed in the position shown in FIGS. 4 and 5, and the plunger 80 is biased against the center of the concave surface 58 of the pawl 44 to maintain the pawl 44 in the position shown in FIG. 3, wherein the clockwise torque teeth 52 and counter-clockwise torque teeth 54 are spaced from the ratchet teeth 36 of the rotatable gear 34, allowing the rotatable gear 34 to freely rotate in either direction. In the neutral position, as seen in FIG. 3, the plunger spring 82 is most compressed and is expanded when the button 70 is rotated to either of the positions shown in FIGS. 8 and 9. This provides a positive detent when a user moves the button 70 to a different ratcheting position and causes the button 70 to move through the neutral position. Also, the force exerted by the spring 82 on the plunger 80 which causes the plunger 80 to frictionally engage the concave surface 58 in the neutral position, may prevent accidental button 70 movement (and direction switch of the pawl 44) if a user bumps the button 70.

Figure 10:
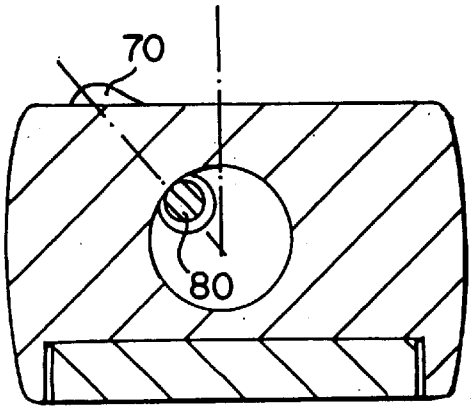
FIG. 10 is a further enlarged sectional view taken generally along line 10—10 of FIG. 8.
Figure 8:
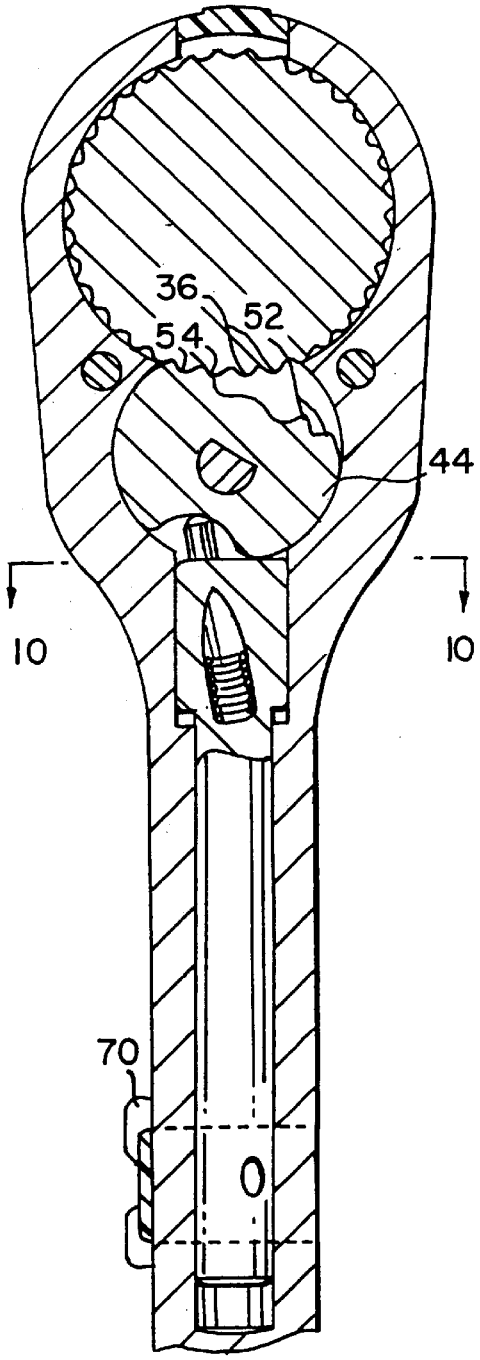
FIG. 8 is a sectional view similar to FIG. 3 when the operating mechanism has been placed in a first position.

When a user rotates the button 70 in a clockwise direction from the neutral position, as seen in FIG. 7, to the position shown in FIGS. 8 and 10, so that the cylindrical portion 75 contacts sidewall 65*b*, the rod 66 is rotated (about 40°, see FIGS. 5 and 10) and the bullet shaped head 84 of the plunger 80 is slid or rolled along and pushes against the concave surface 58 to bias the pawl 44 to the position shown in FIG. 8, wherein the counter-clockwise torque teeth 54 are engaged with the teeth 36 of the rotatable gear 34 to allow the rotatable gear 34 to rotate or ratchet in a clockwise direction in use and prevent the rotatable gear 34 from rotating in a counter-clockwise direction, so that the square drive 38 and attached socket can apply torque to a fastener in a counter-clockwise direction. The shape of the bullet-shaped head 84 advantageously allows it to roll against the concave surface 58, which aids in preventing wear of the parts.

Figure 11:
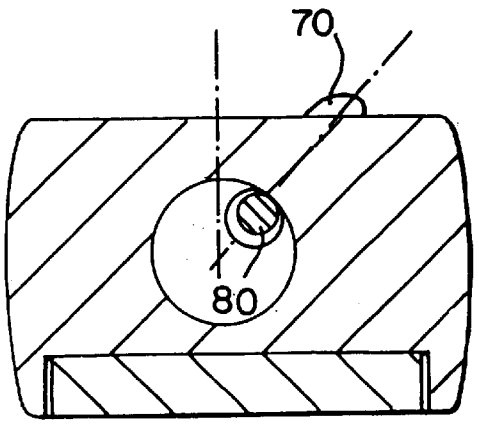
FIG. 11 is a further enlarged sectional view taken generally along line 11—11 of FIG. 9.
Figure 9:
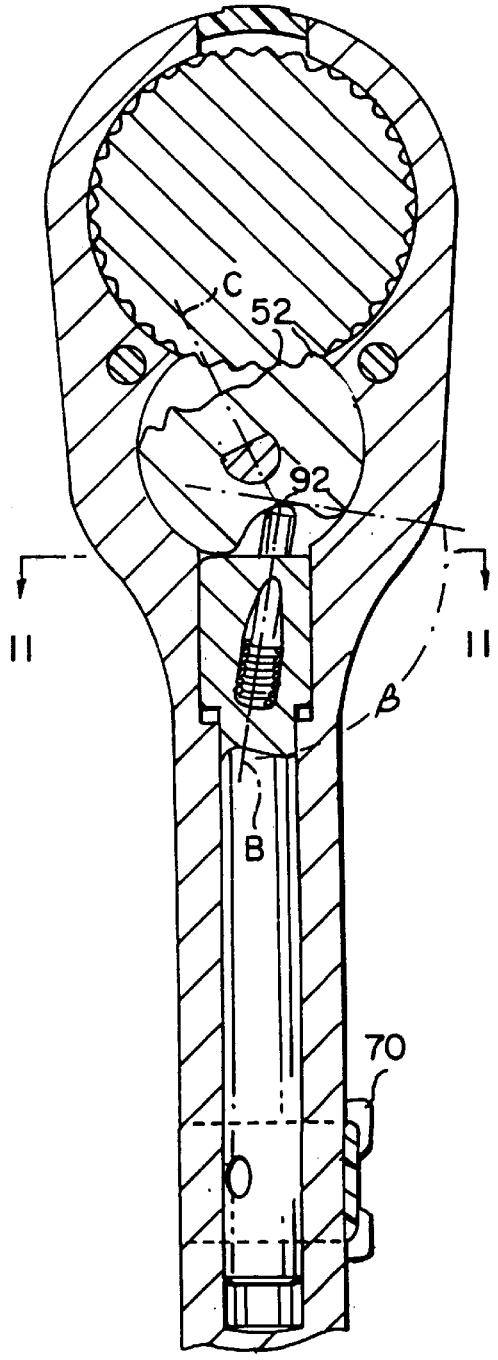
FIG. 9 is a sectional view similar to FIG. 3 when the operating mechanism has been placed in a second position.

When a user rotates the button 70 in a counter-clockwise direction from the neutral position, as seen in FIG. 7, to the position shown in FIGS. 9 and 11, so that the cylindrical portion 75 contacts sidewall 65*a*, the rod 66 is rotated (about 40°, see FIGS. 5 and 11) and the bullet-shaped head 84 of the plunger 80 is slid or rolled along and pushes against the concave surface 58 to bias the pawl 44 to the position shown in FIG. 9, wherein the clockwise torque teeth 52 are engaged with the teeth 36 of the rotatable gear 34 to allow the rotatable gear 34 to rotate or ratchet in a counter-clockwise direction in use and prevent the rotatable gear 34 from rotating in a clockwise direction, so that the square drive 38 and attached socket can apply torque to a fastener in a clockwise position.

Figure 5:
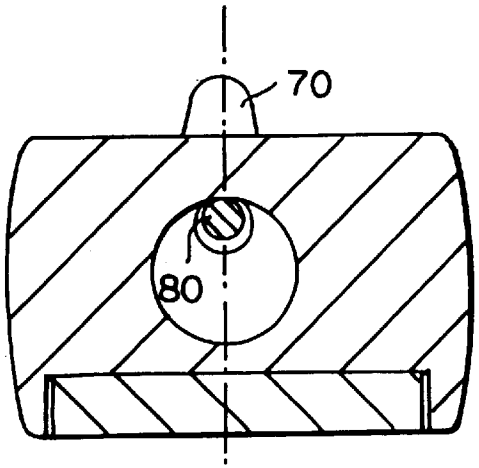
FIG. 5 is a further enlarged sectional view taken generally along line 5—5 of FIG. 3.

As previously discussed, and as seen in FIG. 6, the axis B of bore 76 and the plunger 80 is inclined with respect to the axis A of the rod 66. This allows the plunger 80 to be rotated about the axis A in an arc of about 80 degrees, as seen in FIGS. 5, 10 and 11, which allows the plunger 80 to bring the pawl 44 to the position shown in FIGS. 3, 8 and 9. Preferably, the axes A and B are inclined to form an angle $\alpha$ of about 13°. When the rod 66 has been rotated about 40°, as seen in FIGS. 8 and 9, vertical planes respectively running through axes A and B, form an angle $\Delta$ of about 8°. However, it will be appreciated that the angles $\alpha$ and $\Delta$ could have other values.

Figure 9A:
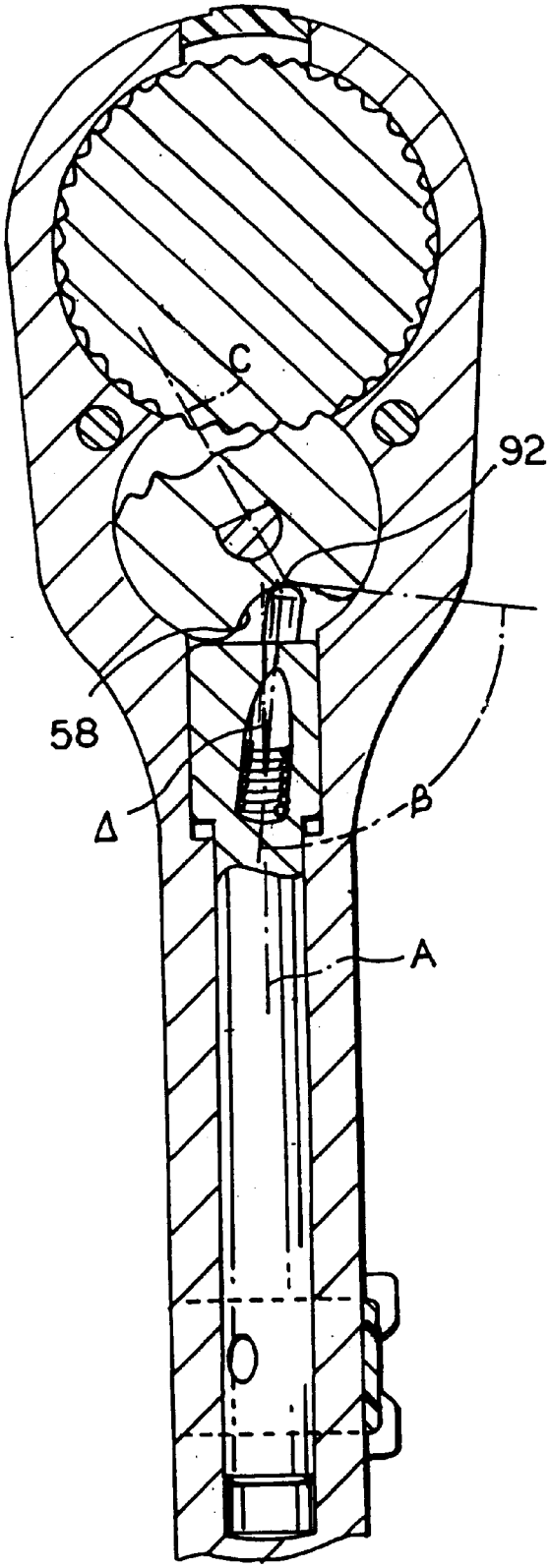
FIG. 9*a* is a sectional view similar to FIG. 9, where the gear is ratcheting.

As seen in FIG. 9, the plunger 80 contacts the concave surface 58 of the pawl 44 at a contact point 92. Preferably, as seen in FIG. 9, when the teeth 36 of the gear 34 are engaged with the teeth 52 of the pawl 44, the axis B and a line tangent to the contact point 92 form an angle $\beta$ of about 120°. As seen in FIG. 9*a*, when the pawl 44 rotates and its teeth 52 over run (during ratcheting) the gear teeth 36, the contact point 92 changes and the contact angle $\beta$ decreases to about 90°, such as to 85°. At this point the plunger 80 is pushed further into the bore 76 because the concave surface 58 has rotated closer towards the plunger 80, which causes the spring 82 to compress to its maximum. Since the contact angle is about 90°, the force vector acting on the plunger 80 is close to a straight line which minimizes side loading of the plunger 80 which would tend to tilt it against the walls forming bore 76. This allows ease of use and prevents wear to both parts. Additionally, the angle $\Delta$ being 8° also aids in preventing side loading. As seen in FIGS. 9 and 9*a*, the concave surface 58 has a central plane C bisecting it. When the pawl 44 is not in the neutral position and has been rotated 40°, the angle $\Delta$ being 8° ensures that the contact point 92 where the plunger 80 contacts the concave surface 58 lies to one side of the central plane C (or is over-center). When the gear is ratcheting, as in FIG. 9*a*, the contact point 92 is further over-center than when the teeth 36, 52 are engaged as in FIG. 9. The over center contact point 92 of the plunger

80 in relation to the central plane C is important so that the plunger 80 can always move the pawl 44 back into engagement with the gear 32. Also, the over-center position enables the spring 82 to always maintain a force on the pawl 44 so it does not come out of engagement with gear 32.

Figure 12:
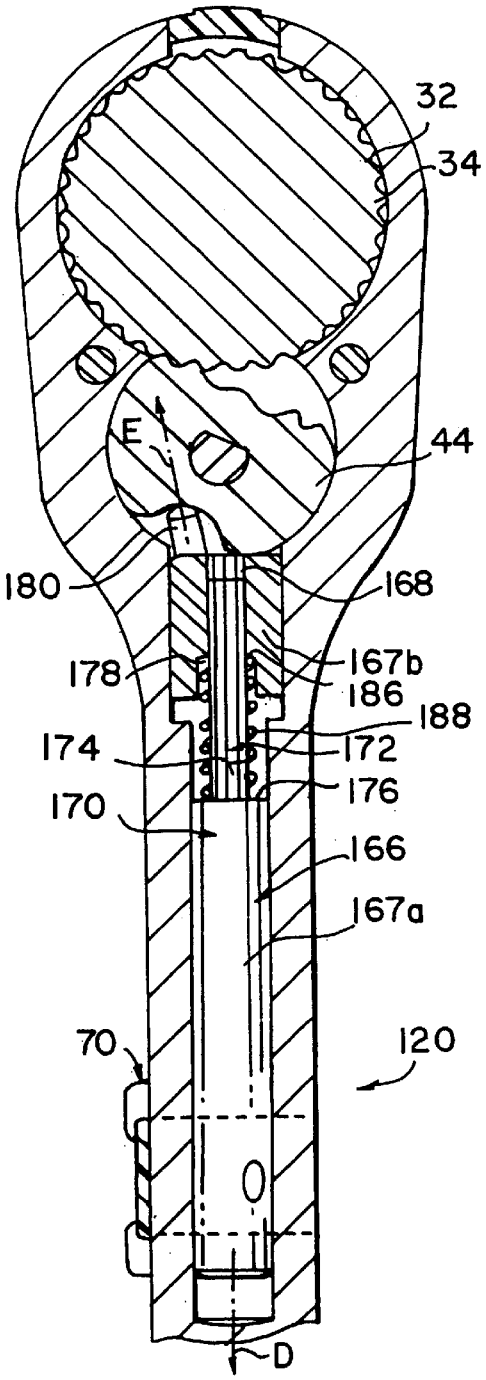
FIG. 12 is a sectional view similar to FIG. 8 showing an alternative embodiment.

Referring to FIG. 12, an alternative ratchet wrench 120 is provided which is identical to wrench 20 except that a new rod 166 and plunger 180 which differ from the plunger 66 and rod 80 of wrench 20 are provided.

The rod 166 has an axis D and is a two-piece construction and includes an elongated generally cylindrical rod portion 167*a*, and a larger-diameter, generally cylindrical engaging portion 167*b*. The rod portion 167*a* has a substantially cylindrical rod portion 170 coupled to the button 70 in the same manner as the wrench 20 of FIGS. 1–11. The cylindrical rod portion 167*a* also includes a smaller-diameter splined end portion 172 having a plurality of splines 174. A shoulder 176 is formed between portions 170 and 172.

Figure 13:
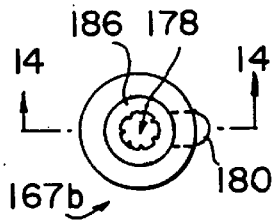
FIG. 13 is an end elevational view of the engaging portion of the turn rod of FIG. 12.
Figure 14:
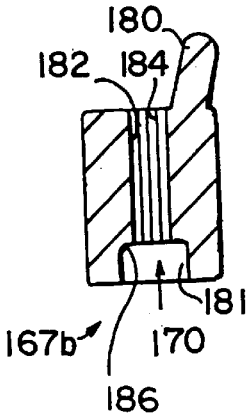
FIG. 14 is an enlarged sectional view taken generally along line 14—14 of FIG. 13.

Referring to FIG. 13, engaging portion 167*b* has a bore 178 coaxial with axis D. The bore 178 has a larger-diameter portion 181 communicating with a smaller diameter portion 182 having a plurality of splines 184. A shoulder 186 is formed between portions 181 and 182. As seen in FIG. 12, the splined end portion 172 is slidably disposed in the smaller-diameter portion 182 of the bore 178.

The plunger 180 is generally bullet-shaped and has an axis E and is unitary with the engaging portion 167*b*. The axis E of the plunger 180 and the axis D of the rod form an angle of about 13°.

A spring 188 is disposed about the splined-end portion 172 between shoulders 176 and 186 to bias the bullet-shaped plunger 180 against the concave surface 58 of the pawl 44.

The plunger 180 and rod 166 function in substantially the same way as the plunger 80 and rod 66 of FIGS. 1–11. When the cylindrical rod portion 167*a* is rotated by the button 70, the splines 174 at the spline end portion 172 of the cylindrical rod portion 170 engage the splines 184 of the elongated generally cylindrical rod portion 167*a* causing it and the plunger 180 to rotate about axis D to bias the pawl 44 into and out of engagement with the gear 32 in the same manner as rod 66 and plunger 80 bias the pawl 44, as discussed above.

During ratcheting of the gear 32, the plunger 180 and the integral engaging portion 167*b* move axially up and down the axis D of the rod 166 compressing the spring 188.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A ratchet wrench comprising:

a handle having an exterior surface;

a head coupled to the handle;

a rotatable gear disposed in the head and having ratchet teeth;

a rotatable pawl moveable between a first pawl position in which the pawl is engaged with the gear to allow rotation of the gear in a first direction and substantially prevent rotation of the gear in a second direction and a second pawl position in which the pawl is engaged with the gear to allow rotation of the gear in the second direction and substantially prevent rotation of the gear in the first direction;

an elongated rotatable rod disposed in the handle having an actuator disposed at a first end of the rod and inclined with respect to an axis defined by the rod, the rod being rotatable from a first rod position wherein the actuator biases the pawl to the first pawl position and to a second rod position wherein the actuator biases the pawl to the second pawl position; and an operating mechanism disposed at the exterior surface of the handle and coupled to the rod.

2. The wrench of claim 1, wherein the rod includes first and second discrete portions, the first portion rotatably coupled to the second portion and moveable along the axis of the rod.

3. The wrench of claim 2, wherein the actuator is integral with and projects from the first portion.

4. The wrench of claim 3, and further comprising a spring carried by the rod and engaged with the first portion to bias the actuator against a concave detent surface of the pawl.

5. The wrench of claim 1, wherein the rod includes a bore at the first end, the actuator being disposed in the bore.

6. The wrench of claim 5, wherein the actuator includes a plunger and spring.

7. The wrench of claim 6, wherein the pawl includes a concave detent surface, wherein when the rod is in the first or second rod position the plunger is biased against the concave detent surface.

8. The wrench of claim 7, wherein the pawl has a thickness and the concave detent surface extends along the entire thickness of the pawl.

9. The wrench of claim 7, wherein the plunger has a plunger axis and contacts the concave detent surface at a contact point wherein when the rod is in the first or second rod position, a line tangent to the contact point on the concave detent surface forms a contact angle of between about 85° to about 120° with the plunger axis.

10. The wrench of claim 7, wherein the plunger has an axis that forms an angle of about 13° with respect to the axis of the rod.

11. The wrench of claim 1, wherein the handle has a substantially cylindrical portion, the operating mechanism is disposed at the cylindrical portion and extends only about a portion of the circumference of the cylindrical portion.

12. The wrench of claim 11, wherein the operating mechanism includes an engaging portion engageable by a user and projecting radially outwardly from the substantially cylindrical portion.

13. The wrench of claim 12, wherein the engaging portion is substantially triangular in transverse cross-section and is shaped and dimensioned to receive contours of a user's fingers.

14. The wrench of claim 1, wherein the operating mechanism is spaced from the head.

* * * * *